US006499651B2

(12) United States Patent
Gerrie et al.

(10) Patent No.: US 6,499,651 B2
(45) Date of Patent: Dec. 31, 2002

(54) COMBINATION MAILER AND POCKET FILE

(75) Inventors: William Gerrie, Webster; Louis Thyroff, Pittsford, both of NY (US)

(73) Assignee: Omnifile, Inc., Rochester, NY (US)

( * ) Notice: Subject to any disclaimer, the term of this patent is extended or adjusted under 35 U.S.C. 154(b) by 0 days.

(21) Appl. No.: 09/832,667

(22) Filed: Apr. 11, 2001

(65) Prior Publication Data

US 2002/0096557 A1 Jul. 25, 2002

Related U.S. Application Data

(63) Continuation-in-part of application No. 09/766,745, filed on Jan. 22, 2001.

(51) Int. Cl.[7] ..... B65D 27/00
(52) U.S. Cl. ..... 229/67.1; 229/305
(58) Field of Search ..... 229/67.1, 67.3, 229/67.4, 302, 305, 92.8, 92.7

(56) References Cited

U.S. PATENT DOCUMENTS

| | | | | | |
|---|---|---|---|---|---|
| 403,604 | A | * | 5/1889 | Donnell | 229/80 X |
| 688,552 | A | * | 12/1901 | Shivler | 229/92.7 |
| 2,317,335 | A | * | 4/1943 | Whitman | 229/305 |
| 2,345,793 | A | * | 4/1944 | Chapel | 229/67.1 |
| 2,538,894 | A | | 1/1951 | Bender | |
| 4,727,988 | A | * | 3/1988 | Erickson | 229/313 |
| 5,290,225 | A | * | 3/1994 | Younger | 229/305 X |
| 5,678,756 | A | * | 10/1997 | Sugiura | 229/92.8 X |
| 6,190,298 | B1 | | 2/2001 | Blumberg | |

FOREIGN PATENT DOCUMENTS

| | | | | |
|---|---|---|---|---|
| AU | 243676 | * | 5/1960 | 229/92.8 |

* cited by examiner

*Primary Examiner*—Jes F. Pascua
(74) *Attorney, Agent, or Firm*—Brian B. Shaw, Esq.; Roger Aceto, Esq.; Harter, Secrest & Emery LLP

(57) ABSTRACT

A combination mailer and a pocket file is disclosed. The combination includes a first file panel and a second file panel foldably connected together along a first fold line. The second file panel is foldably connected to a first mailer panel along a second fold line. The second file panel includes a separation line intermediate the first fold line and the second fold line. A second mailer panel is foldably connected to the first mailer panel along a third fold line, whereon a closure flap is foldably connected to the second mailer panel along a closure fold line.

22 Claims, 8 Drawing Sheets

COMBINATION MAILER AND POCKET FILE

This is a continuation-in-part of application Ser. No. 09/766,745, filed Jan. 22, 2001.

FIELD OF THE INVENTION

The invention is related to mailers and pocket files, and more specifically, to a combined mailer and pocket file that can withstand shipping or mailing and provide a separable pocket file having an aesthetically pleasing appearance.

BACKGROUND OF THE INVENTION

Informational materials are often sent through the mail. Typically, they may consist of information sent to a recipient in response to a request or they may be unsolicited promotional materials. Often the materials are a group of several papers contained in an envelope. The recipient may wish to save the papers after removing them from the envelope and examining them. However, despite the best of intentions, the recipient may mislay the papers once they are removed from the envelope. Returning them to the envelope does not lend itself to systematic filing. For organized storage of the papers it is necessary for example to insert them into a file folder or a pocket file, which is then stored in some categorized manner.

Therefore, a need exists for a mailing container which enables a sender to mail papers to a recipient who may then use a portion of the container for conveniently filing the papers.

SUMMARY OF THE INVENTION

Generally, the invention is a combination mailer and a pocket file. The invention allows a sender to insert promotional or other materials into the pocket file, wherein the combination mailer can be folded and sealed to preclude unintended separation of the materials from the pocket file, and then mailed to a recipient. Such materials can include for example, printed papers, drawings or photographs. The combination mailer containing the papers is sealed and mailed such that the recipient can cleanly separate the file pocket from the mailer portion. After inspecting any enclosed papers, the recipient can retain the papers in the pocket file. The pocket file is sized to be stored for example in a filing cabinet like any conventional file.

A preferred embodiment of the present invention includes an elongate cardboard blank divided into a succession of generally rectangular panels joined at fold lines. First and second panels respectively provide a first file panel and a second file panel to form the pocket file. The first file panel is folded over onto the second file panel, wherein the common fold line forms the bottom of the pocket file. The first file panel and the second file panel can be joined along the edges perpendicular to the common fold line, to form a pocket for receiving papers which may be inserted through the remaining open side.

Third and fourth panels provide mailer panels which can fold over and enclose the pocket file. A closure flap is connected to the fourth panel along a corresponding fold line and an adhesive or seal is located to attach the closure flap to the third panel.

A separation line is provided in the second file panel so that the pocket file can be cleanly detached from the mailer panels. The separation line is normally perforated, but may be any line where the material has been weakened.

The embodiments of the invention disclosed below serve to protect papers contained in the pocket file as well as protect the pocket file during mailing, and further allow a recipient to detach the pocket file and use it as a ready-made free standing file folder. The pocket file can include a projecting tab on which identifying material can be preprinted or which can be left blank for the recipient to mark.

The projected markets for the combination mailer include businesses that mail out informational materials. The materials could for example include tourist information, real estate information with floor plans or maps, or a wide range of product information for both commercial and private recipients. The promotional materials can be printed on an inside surface of the mailer as well as retained within the pocket file.

It is an advantage of the invention that the recipient can open the mailer, remove and examine the papers which are contained in the pocket file, then optionally return the papers to the pocket file; whereat the pocket file can be cleanly detached from the combination mailer and is configured to be stored and readily identified in a suitable filing system such as a filing cabinet. Therefore, the recipient who desires to store the papers has no need to obtain a separate file folder.

DETAILED DESCRIPTION OF THE PREFERRED EMBODIMENT

Figure 1:
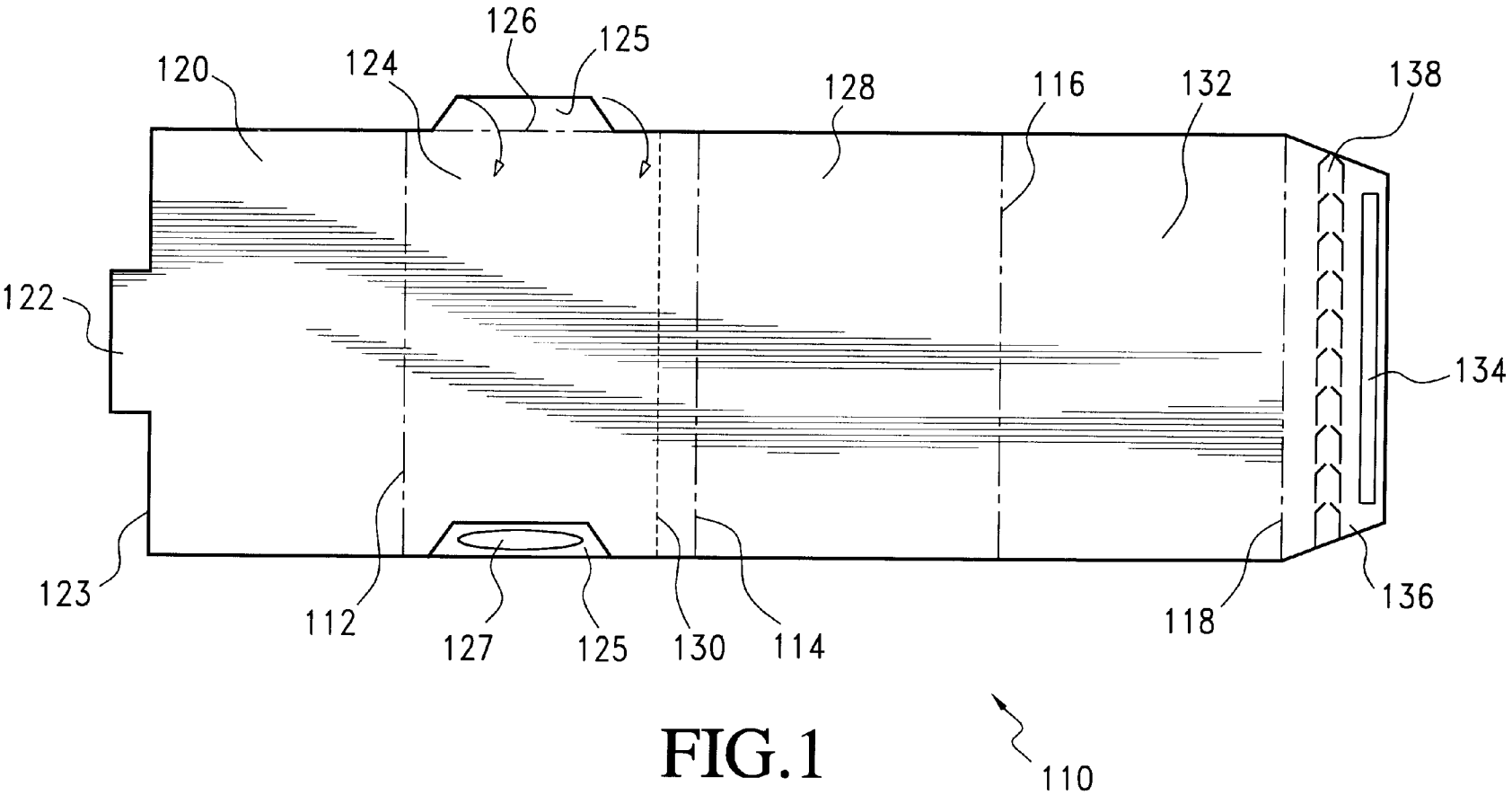
FIG. 1 is an illustration of a blank for making an embodiment of the present invention.
Figure 2:
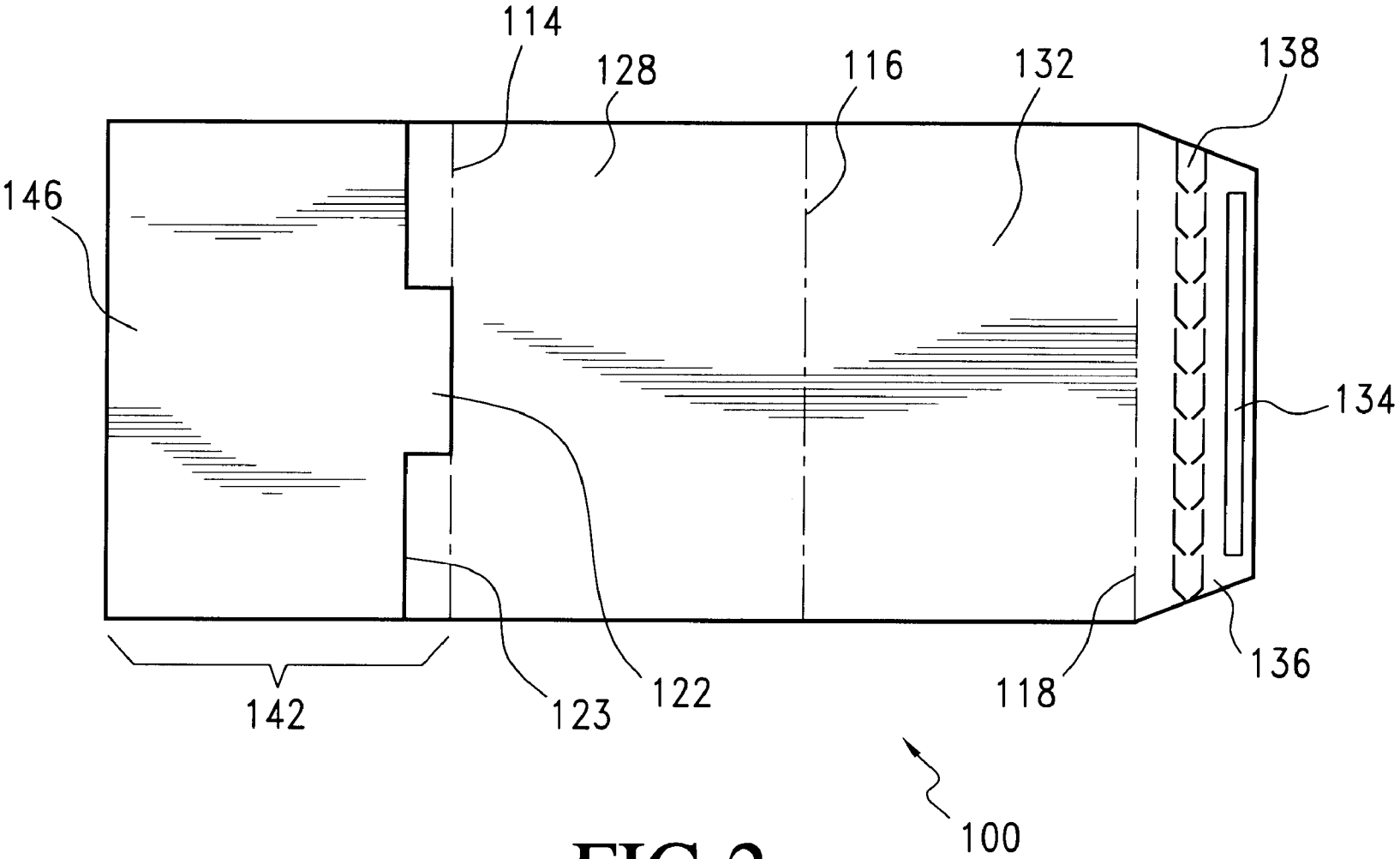
FIG. 2 is a rear plan view of the invention.
Figure 3:
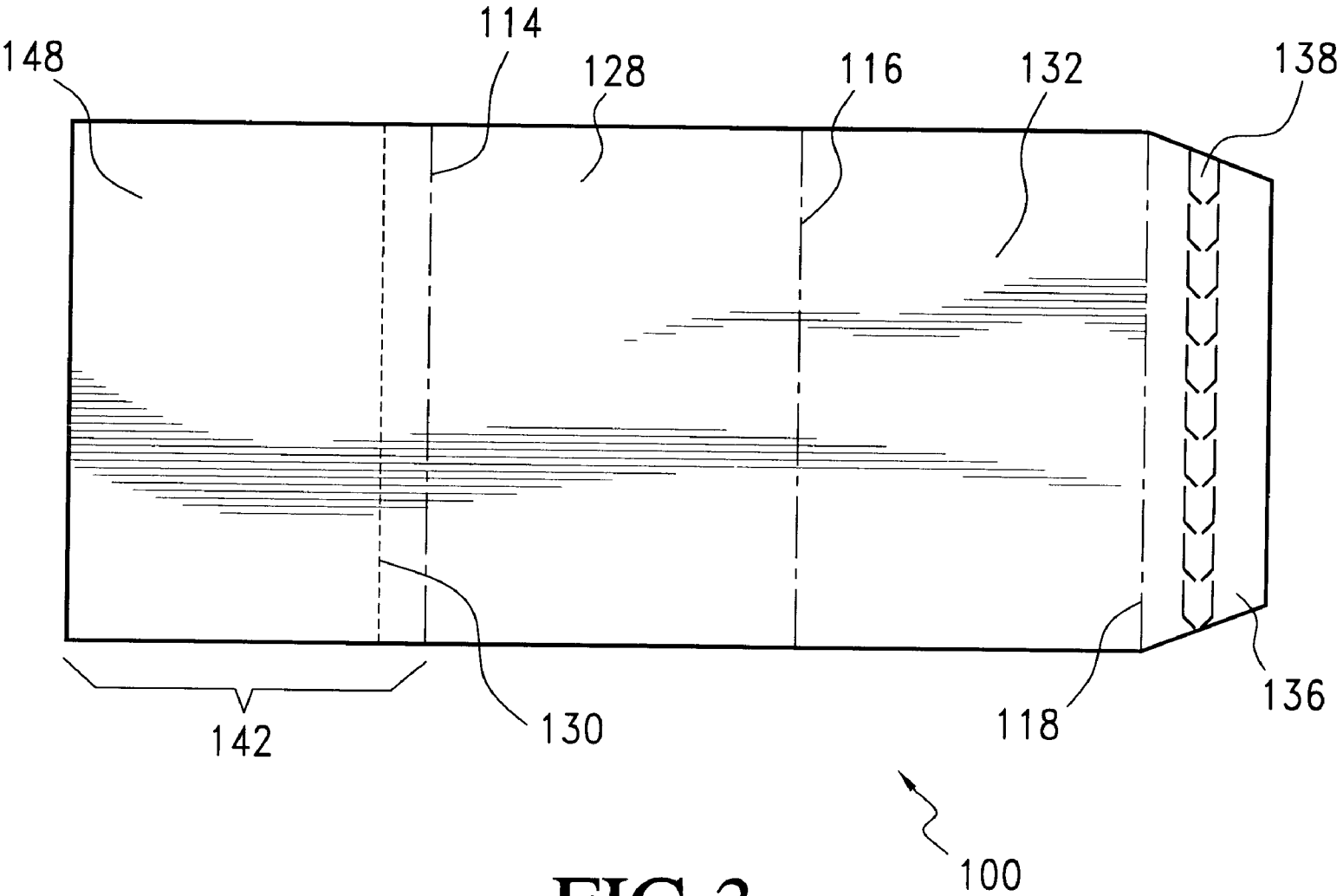
FIG. 3 is a front plan view of the invention.
Figure 4:
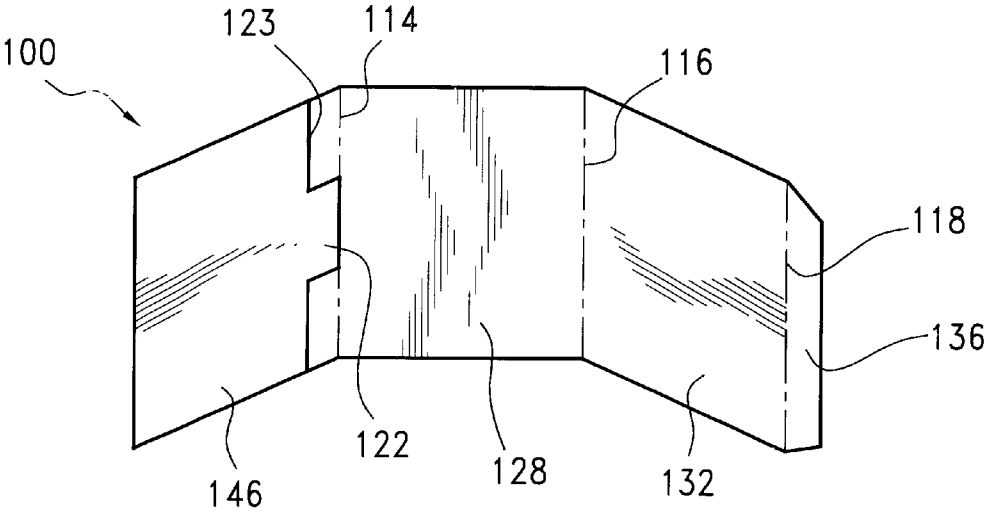
FIG. 4 is a rear perspective view of the invention.
Figure 5:
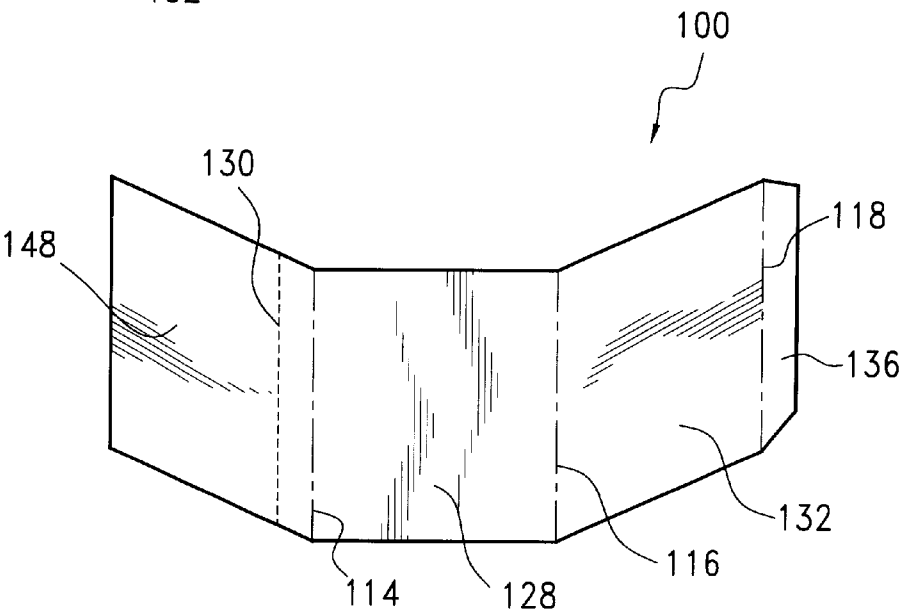
FIG. 5 is a front perspective view of the invention.

Referring to FIG. 1, a combination pocket file and mailer 100 including a pocket file 140 is formed from a blank 110. The blank 110 includes an elongate length of material such as paperboard, board, composite, plastic, or corrugated cardboard. First parallel fold line 112, second parallel fold line 114, third parallel fold line 116 and closure fold line 118 divide the blank 110 into successive first, second, third and fourth panels 120, 124, 128, and 132, and a closure flap 136. The widths of the first and second panels 120 and 124 may be identical, but thereafter the width of each panel increases slightly, the panel 132 adjacent to the flap 136 being the widest. This is to facilitate the folding of the combination mailer 100 as discussed below. The term fold line refers to lines that make it easy to bend between adjacent portions of the blank. In a preferred embodiment, the blank 110 is scored so that the fold lines all bend in the same direction. That is, the fold lines may have a preferred bending direction.

The first panel 120, is connected to the second panel 124 along the first fold line 112, and is a first file panel of the pocket file 140 and typically forming a rear panel. The first file panel 120 has a tab 122 projecting from a free edge 123 opposed to the first fold line 112.

Figure 14:
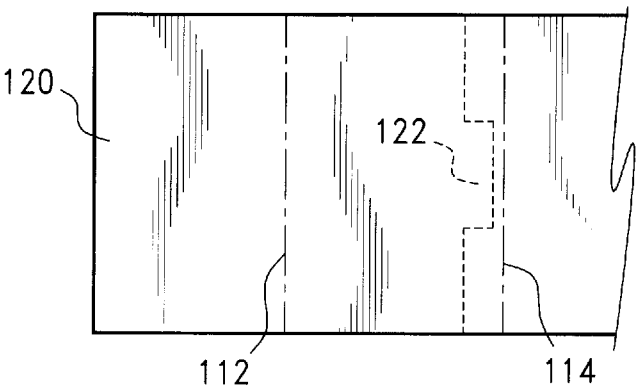
FIG. 14 is a view illustrating another embodiment of the invention.

The second panel 124, is connected to the third panel 128 along the second fold line 114, and forms a second file panel typically being a front of the pocket file. A separation line 130 is provided on the second file panel 124 intermediate the first fold line 112 and the second fold line 114. Preferably, the separation line is proximal to the second fold line 114. The separation line 130 defines the boundary between the pocket file 140 and the remainder of the combination mailer 100, and can be in the form of a perforation or some other weakness in the material which allows a clean separation. Optionally the tab 122 can be included in the second panel 124 and the separation line 130 configured to define its boundaries as shown in FIG. 14.

The second file panel 124 includes extensions 125 connected along longitudinal fold lines 126. The extensions are located intermediate the first fold line and the separation line 130. It is understood the extensions can be provided on the first file panel 120 instead of the second file panel 124. In an alternative configuration the extensions are located along one of the mailer panels 128, 132. Then the pocket file is formed with only the bottom fold of the first fold line 112. The alternative extensions on the mailer panel are used to effectively seal the combination mailer during the mailing process, such that the resulting pocket file is open ended.

The combination mailer 100 is shown in FIGS. 2–5. It is formed from the blank 110 when the extensions 125 are folded along the longitudinal fold lines 126 onto the second file panel 124, the first file panel 120 then being folded along fold line 112 onto the second file panel 124. The extensions 125 are bonded to the second file panel 124 by using any conventional glue or sealant known in the art. The extensions 125 can be disposed intermediate the first file panel 120 and the second file panel 124, or attached to locate the first file panel intermediate the extensions and the second file panel. Sealing the first file panel 120 and the second file panel 124 in this manner leaves an opening 144 and three closed edges 150.

The third panel is a first mailer panel 128 and extends from the second fold line 114 to the third fold line 116. The fourth panel is a second mailer panel 132 and is foldably connected to the first mailer panel 128 along the third fold line 116.

The closure flap 136 is attached to the second mailer panel 132 along the closure fold line 118. The closure flap 136 can include an adhesive strip or seal 134 so that the closure flap will bond to the first mailer panel 128 when the mailer is prepared for mailing. The preferred embodiment of the seal 134 includes a peel and seal type strip where the adhesive 134 strip has a protective cover. This cover is removed when the item is ready to be mailed and the flap can then be sealed to the mailer. A zip strip 138 is located between closure fold line 118 and adhesive strip 134. It is supplied so that a recipient may easily open the mailer without risking damage to the pocket file 140.

The separation line 130 allows the pocket file 140 to be detached from the mailer panels 128, 132 after the combination mailer and pocket file 100 has been folded into a mailable configuration. The distance between the separation line 130 and the fold line 114 is slightly less than the distance between the free edge 123 and the fold line 114. Consequently, the first panel 120 covers the separation line 130 when it is folded over the second panel 124. In other words, in the detached pocket file 140, the file front 148 overlays a little less than the entire area of the file rear 146 excluding the tab 122. This renders the opening 144 readily visible and accessible from the front of the pocket file 140. In addition, it allows for any of a variety of tab configurations to be employed.

The second mailer panel 132 is connected to the first mailer panel 128 along the third fold line 116. Both mailer panels can include printed indicia such as text or graphics. The mailer panels 128, 132 can include ruled areas or may simply be left blank. The exterior portion of the second mailer panel 132 will likely include a mailing label.

Figure 7:
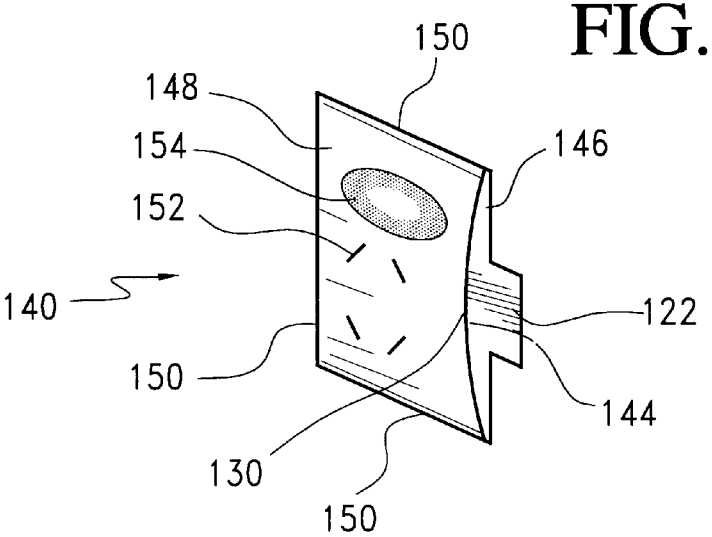
FIG. 7 is a front perspective view of the invention showing more clearly the pocket file.

As shown in FIG. 7, the combination mailer 100, and particularly the portion corresponding to the file front 148, can optionally provide for the attachment of a business card by scoring with short diagonal slits 152 corresponding to the corners of the card. Consistent with retaining the ability to hold papers, the file front 148 or the file rear 146 could have rectangular, circular or other apertures 154 provided to draw the attention of the recipient to portions of papers showing therethrough which may be selected by the sender as particularly attractive. Furthermore, such apertures 154 could also be provided in the mailer panels 128 or 132; a piece of clear plastic or film may be placed over such apertures 154.

While the present invention is primarily meant to be used for receiving standard sized papers, for example letter size or legal size, it is envisaged that it would be produced in a variety of sizes. In one particular embodiment, suitable for standard letter size papers, the blank is 11⅝ inches (295 mm) high. The first panel 20 is approximately 8½ (216 mm) inches wide not including the tab 122 and approximately 9¼ inches (235 mm) including the tab 122. The second, third and fourth panels are respectively approximately 9¼ 9⅜ and 9½ inches (235, 238 and 241 mm) wide. The increase in width across succeeding panels eases folding the panels into a mailable configuration. The flap 136 is approximately 1⅝ inches (41 mm) wide.

Printing, foil stamping, die-cut shapes and embossing can be done on the inside or the outside of the mailer.

The present invention is easy and efficient to manufacture. The blank 110 is created first. The length of cardboard or cardstock can be cut from a larger sheet. One method of accomplishing this is by die-cutting the sheet, which leaves relatively smooth borders that are aesthetically pleasing to the eye.

After the blank 110 is completely cut, it can be folded and glued in one trip through an assembly line. The adhesive strip 134 is applied, the extensions 125 are folded over onto the second panel 124 and adhesive or sealant lines 127 are applied to the exposed portions of the extensions 125, or to the corresponding areas of the first panel 120. Then the first file panel 120 can be automatically folded over onto the second file panel 124 to bond with the extensions 125 and form the pocket file 142. In the concertina, or accordion style folder, pleats are formed on one of the first file panel or the second file panel, in place of the extensions. The number of pleats is dictated by the desired size or capacity of the resulting pocket file.

Figure 9:
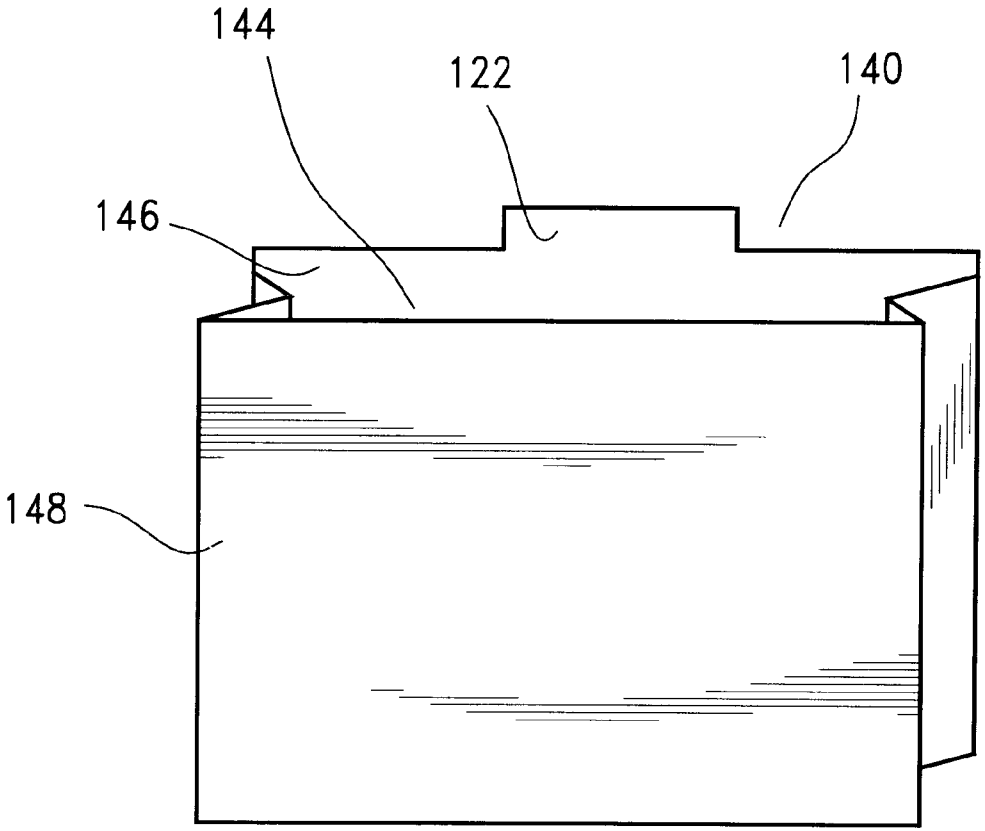
FIG. 9 is a front perspective view of the pocket file in the second embodiment of the invention.
Figure 8:
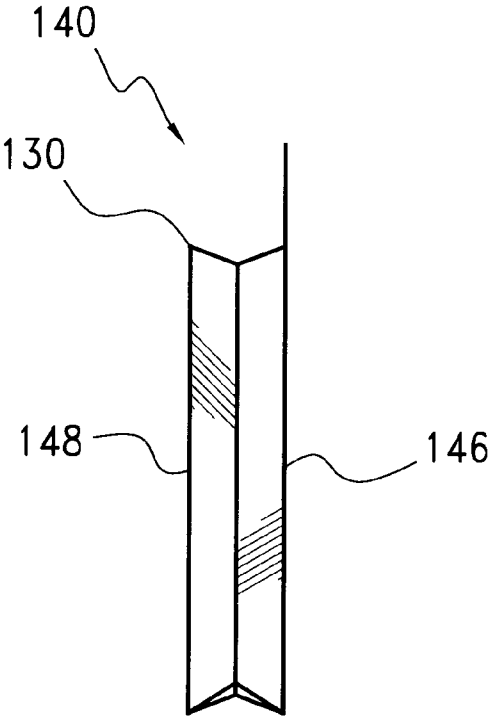
FIG. 8 is a side elevation of the pocket file in a second embodiment of the invention.

In another embodiment of the invention, shown in FIGS. 8 and 9, the pocket file 140 can be configured to open in a concertina-like fashion as is known in the art, as shown in FIGS. 8 and 9, so it can accept a greater thickness of papers. The mailer panels 128 and 132 are sized accordingly to fully enclose the pocket file 142.

Figure 6:
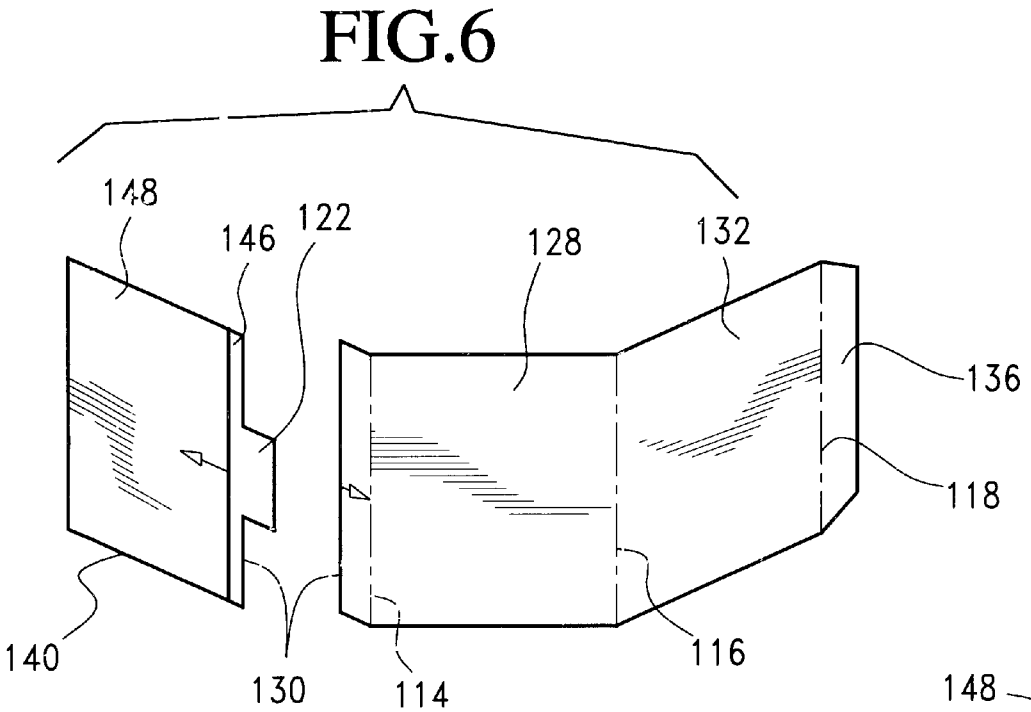
FIG. 6 is a front perspective view of the invention wherein a pocket file has been separated from the remaining part of the invention.
Figure 10:
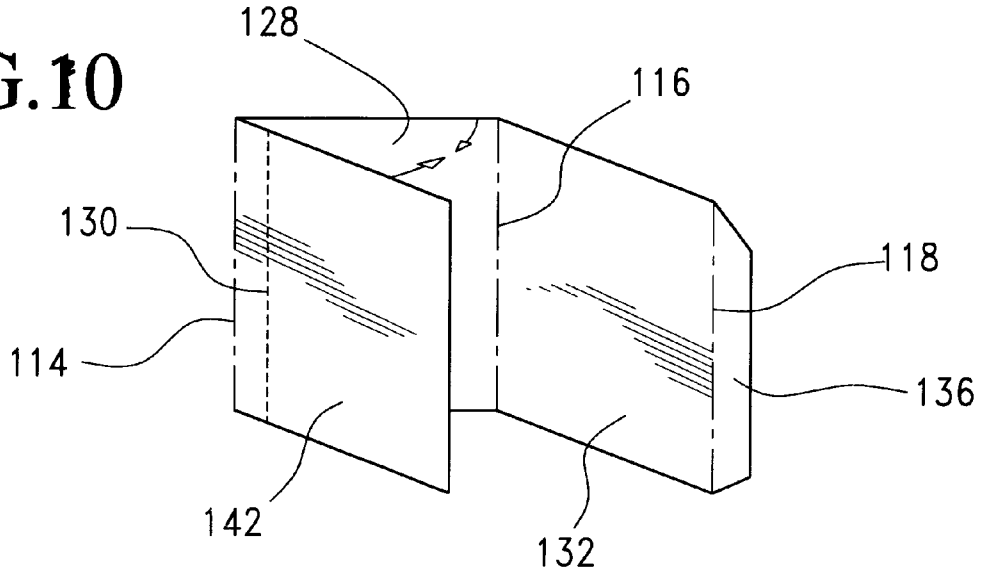
FIG. 10 is a perspective view of the invention in one stage of closure.
Figure 11:
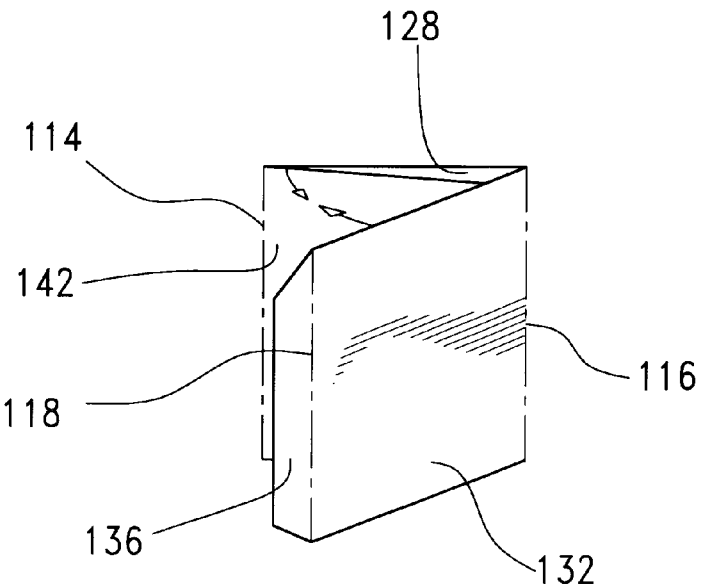
FIG. 11 is a perspective view of the invention in another stage of closure.

To prepare the present invention for mailing, a user can first insert papers through the opening 144 between the file front 148 and the file rear 146. The pocket file 142 can then be folded over onto the first mailer panel as shown in FIG. 10. The second mailer panel 132 can then be folded over onto the folded file portion 142 and first mailer panel 128 as shown in FIG. 11. Now both the file front 148 and file rear 146 are entirely protected. Finally the flap 136 is folded over and sealed to the back of the first mailer panel 128. The recipient of the mailer may then open the mailer by pulling the zip strip 138, and detach the pocket file 140 from the rest of the combination mailer 100 as shown in FIGS. 6 and 7.

Figure 12:
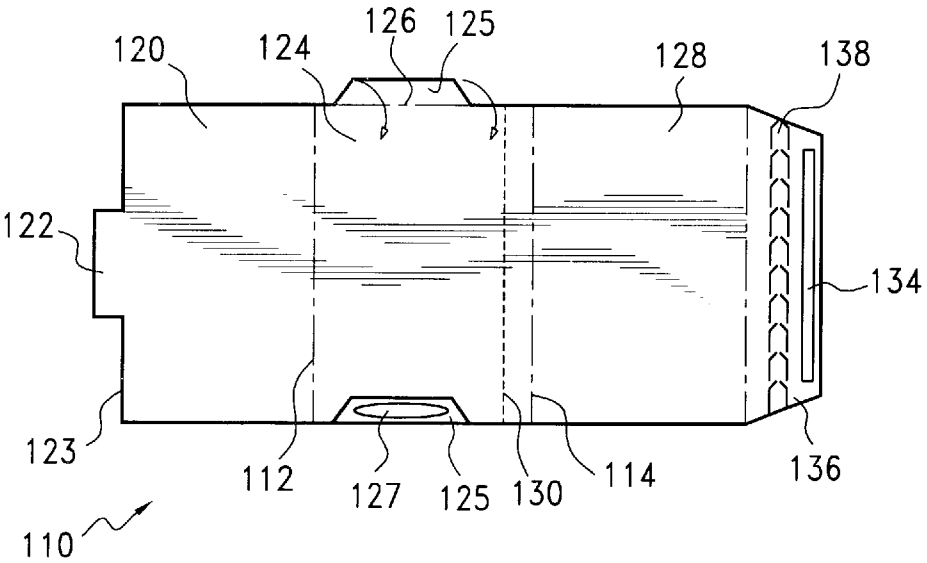
FIG. 12 is a plan view of a blank for forming an alternative configuration of the invention.
Figure 13:
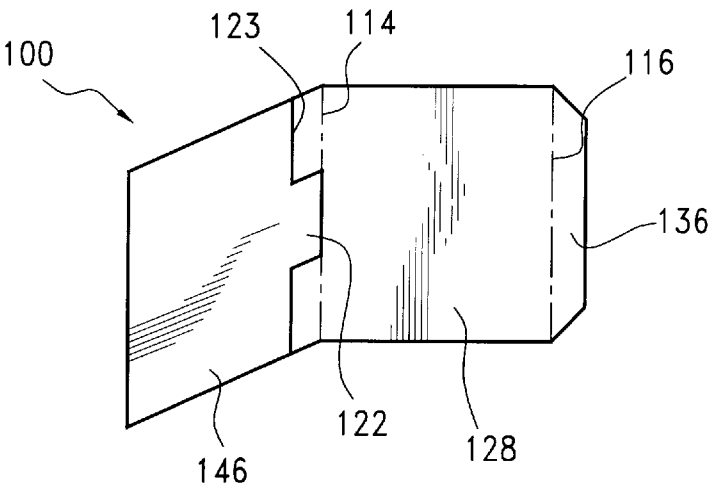
FIG. 13 is a perspective view showing assembly of the combination mailer of FIG. 12.

In a further configuration as shown in FIGS. 12 and 13, a single mailer panel 128 can be used, wherein the closure flap 136 is foldably connected to the mailer panel as shown in FIGS. 12 and 13. The pocket file remains as described in any of the previous configurations. Upon assembly of this configuration, the mailer panel overlies the first file panel 120 and the closure flap 136 is adhered to the back side of the second file panel 124.

While preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A combination mailer and pocket file, comprising:

(a) a pocket file having a first file panel and a second file panel connected at opposite sides and foldably connected along a first fold line to form a pocket file having an open end opposite the fold line;

(b) a first mailer panel foldably connected to the second file panel along a second fold line;

(c) a file tab on one of the first and second file panels;

(d) a line of perforations extending across the second file panel adjacent and substantially parallel to the second fold line, the line of perforations providing a separation line of weakness across the second panel to allow a clean separation of the first mailer panel including the second fold line from the pocket file portion; and (e) a closure flap foldably connected to the first mailer panel along a closure fold line.

2. The combination mailer and pocket file of claim 1, further comprising an adhesive on the closure flap.

3. The combination mailer and pocket file of claim 1, further comprising a zip strip on the closure flap.

4. The combination mailer and pocket file of claim 1, further comprising extensions extending between the first file panel and the second file panel.

5. The combination mailer and pocket file of claim 1, wherein one of the first file panel and the second file panel includes an aperture.

6. The combination mailer of claim 1, wherein the first file panel and the second file panel are connected along spaced apart lines intersecting the first fold line.

7. The combination as in claim 1 wherein the file tab is on a free edge of the first file panel opposite the first fold line.

8. A combination mailer and pocket file comprising.

(a) a first file panel;

(b) a second file panel connected to the first file panel at opposite sides and foldably connected to the first file panel along a first fold line to form a pocket file having an open end opposite the first fold line;

(c) a file tab on one of the first and second file panels;

(d) a first mailer panel foldably connected to the second file panel along a second fold line;

(e) a second mailer panel foldably connected to the first mailer panel along a third fold line;

(f) a line of perforations extending across the second file panel adjacent and substantially parallel to the second fold line, the line of perforations providing a separation line of weakness to allow a clean separation of the first mailer panel including the first fold line from the pocket file portion; and (g) a closure flap foldably connected to the second mailer panel along, a closure fold line.

9. The combination mailer and pocket file of claim 8, wherein the first file panel, the second file panel, the first mailer panel and the second mailer panel are selected to be disposed in a parallel configuration upon folding about the first fold line, the second fold line and the third fold line.

10. The combination mailer of claim 8, wherein one of the first file panel and the second file panel include an extension sized to engage a remaining one of the first file panel and the second file panel.

11. The combination mailer of claim 8, wherein the second file panel is bonded to the first file panel along a pair of spaced apart lines.

12. A blank for manufacturing a combined pocket file and mailer, comprising:

(a) a first file panel having a free edge at one end;

(b) a second file panel foldably connected to the first panel along a first fold line spaced across the first panel from the free edge;

(c) a file tab extending from the free edge of the first file panel;

(d) a first mailer panel connected to the second file panel along a second fold line;

(e) a flap connected to the mailer panel at a closure fold line opposite the second fold line; and (f) a line of perforations extending across the second file panel adjacent and substantially parallel to the second fold line, the line of perforations forming a separation line of weakness across the second panel to allow a clean separation of the first mailer panel including the second fold line from the pocket file portion.

13. The blank of claim 12, having an extension joined to one of the panels at a corresponding fold line.

14. The blank of claim 12, having a second mailer panel intermediate the first mailer panel and the flap.

15. A method of manufacturing a combination mailer and pocket file, comprising the steps of:

(a) cutting an elongated blank from a larger sheet, the blank having opposite side extensions;

(b) transversely scoring the blank to form a plurality of fold lines that define a first file panel at one end of the blank, a second file panel foldably connected to the first panel along a first fold line, a first mailer panel connected to the second file panel along a second fold line and a closure flap at an opposite end of the blank connected to the mailer panel at a closure fold line;

(c) perforating the second file panel along a line extending generally parallel to the second fold line to provide a separation line of weakness in the second file panel permitting the clean separation of the first mailer panel including the second fold line from the second file panel;

(d) one of the steps of cutting and perforating forming a file tab on the first file panel or second file panel respectively;

(e) longitudinally scoring the blank at the opposed side extensions to form longitudinal fold lines such that each extension is foldably connected to one of the first and second file panels at each of the longitudinal fold lines; and (f) connecting the extension to a remaining one of the first and the second file panels.

16. The method of claim 15, wherein step (b) includes forming the blank with a second mailer panel intermediate the first mailer panel and the flap.

17. The method of claim 15, further comprising applying an adhesive strip to the closure flap.

18. The method of claim 15, further comprising forming a zip strip in the closure flap.

19. The method of claim 15, further comprising forming an aperture in one of the first and second file panels.

20. A method as in claim 15 wherein cutting the blank forms the file tab on a free edge of the first file panel.

21. A method as in claim 15 wherein perforating forms the le tab on the second file panel.

22. A combination mailer and pocket file, comprising:

(a) a pocket file having a first file panel and a second file panel foldably connected along a first fold line, the second file panel including a separation line;

(b) a first mailer panel foldably connected to the second file panel along a second fold line;

(c) a closure flap foldably connected to the first mailer panel along a closure fold line; and (d) the separation line defining a tab on the second file panel.

* * * * *